United States Patent [19]

de Larosiere

[11] Patent Number: 4,615,444

[45] Date of Patent: Oct. 7, 1986

[54] TRAY FOR SUPPORTING ARTICLES IN A PACKAGE

[76] Inventor: Pierre J. de Larosiere, 30 Duque de Palmela, 4C, 1200 Lisbon, Portugal

[21] Appl. No.: 758,830

[22] Filed: Jul. 25, 1985

Related U.S. Application Data

[63] Continuation of Ser. No. 455,585, Jan. 4, 1983, abandoned.

[51] Int. Cl.[4] ..... B65D 1/36

[52] U.S. Cl. ..... 206/427; 206/558; 206/564; 206/565

[58] Field of Search ..... 206/557, 558, 561–564, 206/201, 203, 139, 427, 430–433, 426; 217/18, 19, 21, 26, 26.5, 28; 220/21, 23.83, 23.86; 229/2.5 R

[56] References Cited

U.S. PATENT DOCUMENTS

| | | | |
|---|---|---|---|
| 2,215,252 | 9/1940 | Randall et al. | 217/26 |
| 2,314,198 | 3/1943 | DeReamer | 206/433 |
| 2,352,684 | 7/1944 | Braddock | 220/23.8 |
| 2,614,399 | 10/1952 | Roethel | 220/23.4 |
| 2,776,772 | 1/1957 | Itoda | 217/26.5 |
| 2,965,226 | 12/1960 | Ettlinger, Jr. | 206/565 |
| 3,155,268 | 11/1964 | Fogerty et al. | 220/21 |
| 3,261,531 | 7/1966 | Barth | 229/2.5 R |
| 3,351,264 | 11/1967 | Bostrom | 217/26.5 |
| 3,416,695 | 12/1968 | Bessett et al. | 229/2.5 R |
| 3,791,549 | 2/1974 | Delbrouck et al. | 206/564 |

FOREIGN PATENT DOCUMENTS

| | | | |
|---|---|---|---|
| 1274380 | 9/1961 | France | 206/558 |
| 1447702 | 6/1966 | France | 220/21 |
| 0742959 | 1/1956 | United Kingdom | 206/392 |
| 1490627 | 11/1977 | United Kingdom | 206/557 |

*Primary Examiner*—William Price
*Assistant Examiner*—Jimmy G. Foster
*Attorney, Agent, or Firm*—Dennis H. Lambert

[57] ABSTRACT

An article support tray for supporting a plurality of articles, such as beverage cans, in predetermined spaced relationship to one another in a package containing a plurality of such articles, comprises a flat sheet with article engaging raised ribs on one surface which engage and wedge in place bottom ends of the articles to prevent rubbing together of the articles. A plurality of ribs engage each article around its periphery, and the ribs are shaped to automatically properly align the articles on the tray as the articles near their final position on the tray. The shape and disposition of the ribs on the tray are such that the articles are enabled to slide freely over the surface of the tray until the articles reach their final position of wedged engagement with the tray, and the ribs also reinforce the tray, permitting a very thin, lightweight, inexpensive structure to be used.

7 Claims, 7 Drawing Figures

TRAY FOR SUPPORTING ARTICLES IN A PACKAGE

This application is a continuation of application Ser. No. 455,585, filed 1/4/83 now abandoned.

BACKGROUND OF THE INVENTION

1. Field of the Invention

This invention relates generally to packages for packaging together a plurality of articles. More particularly, the invention relates to a tray which engages and supports in predetermined spaced relationship one end of a plurality of articles, such as beverage cans, in a package of such articles to prevent rubbing together or chiming of the articles during handling and shipment.

2. Prior Art

Various package designs are known in the prior art for packaging together a plurality of articles such as containers of beverage. One of the more commonly used package designs utilizes a shrink wrap of usually transparent film which is wrapped around a plurality of the articles and thermally fused or sealed to form a cohesive, unitary package of the articles. Typically, and particularly in the packaging of beverage cans such as those containing beer or soft drinks, the packages are composed of "six packs" or groups of six cans secured together with various types of packaging materials such as bands, shrink-wrap and the like. A plurality, usually four, of these packs are then typically assembled into a carton or package for subsequent handling and shipment to distribution points and retail outlets.

These cartons are conventionally packaged in one of several different ways, all of which involve relatively expensive and unsightly containers or cartons of cardboard, wood, metal or plastic. The most commonly used carton is constructed of cardboard and either has an open top with relatively high side walls, an open top with relatively low side walls which is shrink-wrapped with the contents, or side walls and a top which closes and seals the contents.

The cardboard cartons which are in widespread use have several disadvantages. They are costly and unattractive in their natural condition and do not permit proper display of the cans. In today's marketplace, merchandising and advertising are extremely important. Consequently, the only alternative to the use of plain cartons is to decorate the carton sides or edges, which adds to the cost of the package. Further, such cartons are dust yielding elements and mechanical handling of the cartons causes dust to be produced, which may then interfere with proper operation of packaging machinery, or in industries such as the beverage industry contamination of the product may result. Perhaps most importantly, beverage cans are typically secured together at only their tops with bands, shrink-wrap and the like, to form "six packs" which are then placed in combinations of four in one of the conventionally used cartons. The unsecured bases of the cans then are able to rub or chime against one another, frequently resulting in wearing through the protective outer layer of the can and enabling corrosion to erode away or weaken the can whereby piercing of the can may occur, enabling the contents to leak out. In some instances, the rubbing or chiming together of the cans may be severe enough to actually pierce the can, causing the contents to leak out. This may occur, for example, when the packages are shipped via rail car, in which vibration accentuates the abrasion of the cans. Obviously, leakage from pierced cans in such an environment causes contamination of many otherwise undamaged cans. Moreover, since the cardboard cartons are susceptible to moisture, the integrity of the package is reduced or destroyed when the carton becomes wet.

Such considerations as discussed above are significant in view of the large number of cans which are used each year, i.e. approximately 55 billion cans for beverage use alone. Thus, reduction of the cost of the package and of the danger of piercing of the cans and contamination of the packages, even if relatively small on an individual basis, results in enormous savings over a period of time.

PURPOSE OF THE INVENTION

It is, therefore, a primary object of this invention to provide a support or tray for holding in predetermined spaced relationship a plurality of articles in a package so that the articles do not rub or chime together during storage, handling and shipment.

Another object of the invention is to provide an inexpensive package which is strong, dust-free, attractive and facilitates display of the articles in the package.

A more specific object of the invention is to provide a tray for holding a plurality of beverage cans in predetermined spaced relationship in a package containing a plurality of such cans, to prevent rubbing together of the cans during storage, handling and shipment, and wherein the tray is inexpensive and lightweight.

A still further object of the invention is to provide a tray for holding a plurality of cans in predetermined spaced relationship, wherein the tray is constructed such that individual trays in a stack of trays are enabled to slide relative to one another for feeding to a loading station in a packaging line for receiving a plurality of cans.

Yet another object of the invention is to provide a tray for holding in spaced relation one end of a plurality of cans in a package, the tray being configured to enable free sliding movement of the cans thereover until the cans reach their final position relative to the tray.

SUMMARY OF THE INVENTION

These objects and other advantages are accomplished by the tray and package as described herein. The tray comprises a flat sheet with a plurality of upstanding ribs on the top surface which engage and support cans placed thereon. The ribs include a plurality of shaped ribs, for instance ring shaped or circular, and a plurality of linearly extending ribs disposed over the top surface of the sheet and spaced and configured such that they support a can thereon for free sliding movement over the surface of the sheet until the can reaches its final position at one of the shaped ribs. The linearly extending ribs include a plurality of support ribs extending into proximity with the shaped ribs and defining a pocket therewith into which the cans are guided and wedged. The support ribs have guide surfaces thereon which engage and guide a can into its final at-rest position on the tray and which wedge the can against the shaped rib to hold the base ends of the cans in spaced relationship and prevent rubbing together or chiming of the cans. The tray is made of lightweight, inexpensive injection molded plastic. The light weight is achieved by the arrangement and configuration of the ribs, which impart strength and rigidity to the sheet or tray and permit the tray to be very thin. Thus, not only is the cost of the tray itself reduced, but the cost for shipping the tray (in packages or cartons of cans, or as a package component to another packager) is also reduced.

BRIEF DESCRIPTION OF THE DRAWINGS

Other objects of this invention will appear in the following description and appended claims, reference being made to the accompanying drawings forming a part of the specification, and wherein like reference characters designate corresponding parts in the several views.

DESCRIPTION OF THE PREFERRED EMBODIMENTS

Figure 1:
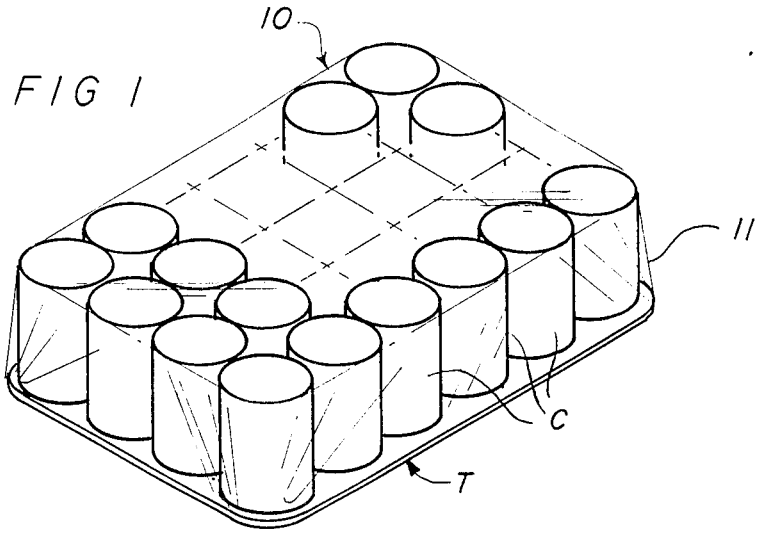
FIG. 1 is a top perspective view of a package incorporating the tray of the invention.
Figure 2:
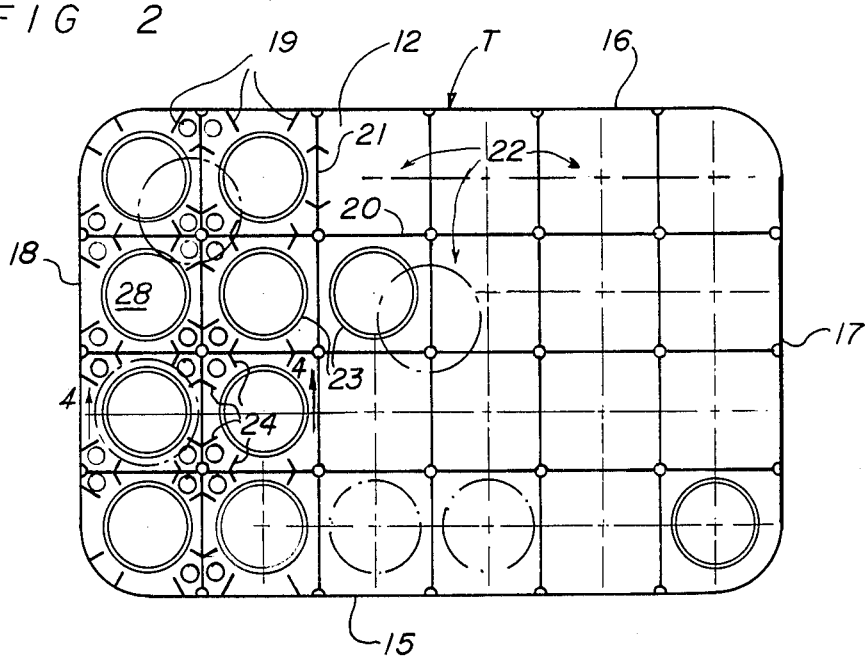
FIG. 2 is a top plan view of the tray of the invention, showing the arrangement of ribs thereon, and indicating in dot-and-dash lines various positions of cans thereon as the cans are moved to their final position.
Figure 3:
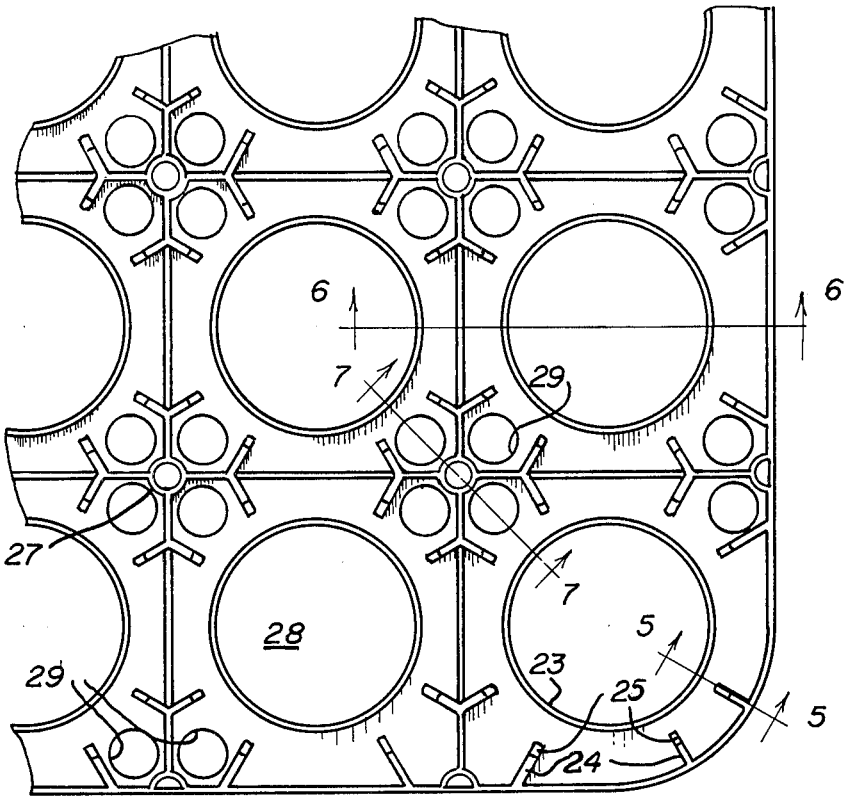
FIG. 3 is a greatly enlarged, fragmentary plan view of a portion of the tray of FIG. 2, showing details of the rib design.
Figure 4:
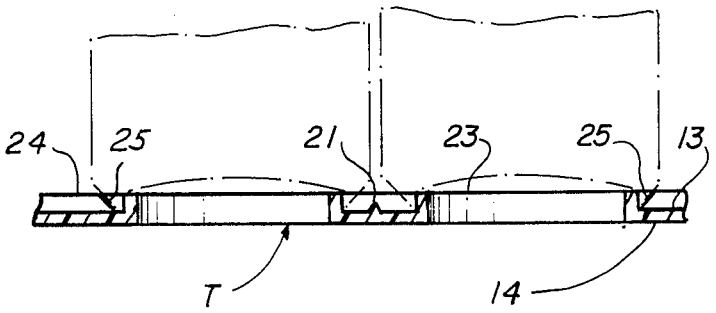
FIG. 4 is an enlarged, fragmentary, sectional view taken along line 4—4 in FIG. 2, showing in dot-and-dash lines the position of two cans held in wedged location on the tray.
Figure 5:
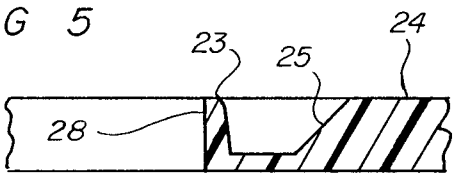
FIG. 5 is an enlarged, fragmentary, sectional view taken along line 5—5 in FIG. 3, showing a detail of the support rib and guide surface formed thereon and indicating in dot-and-dash lines the manner in which a can is supported on the ribs prior to reaching its final position.

Referring more specifically to the drawings, a package incorporating the tray of the invention is indicated generally at 10 in FIG. 1, and comprises the tray T, a plurality of cans C and a shrink-wrap 11 surrounding the tray and cans. The package thus formed is very strong and lightweight, as well as being resistant to damage by moisture, and the cans are fully and attractively displayed in the package. Typically, the cans in the package would be secured together at their top ends in packs of six and four such packs would be assembled in the package 10. The means for securing the tops of the cans does not comprise any part of this invention and any of the conventionally used straps, rings and shrink-wraps, not shown here, could be effectively used.

The tray T, as seen in greater detail in FIGS. 2 through 7, comprises a relatively thin, flat sheet 12 having top and bottom surfaces 13 and 14, opposite side edges 15 and 16 and opposite end edges 17 and 18. The bottom surface 14 is smooth, as best seen in FIGS. 4–7.

Figure 6:
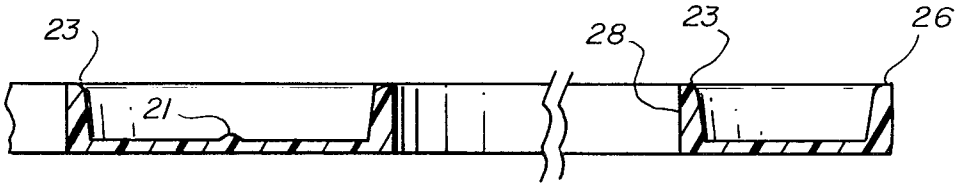
FIG. 6 is an enlarged, fragmentary, sectional view taken along line 6—6 in FIG. 3.
Figure 7:
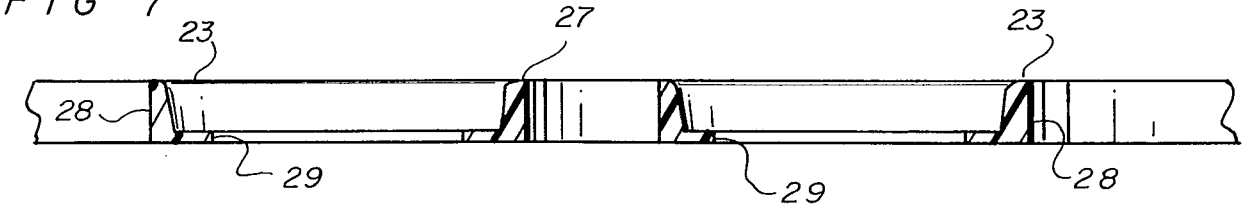
FIG. 7 is an enlarged, fragmentary, sectional view taken along line 7—7 in FIG. 3.

A plurality of upstanding ribs 19 are formed on the top surface of the sheet, and include a plurality of longitudinally and transversely extending ribs 20 and 21, respectively, forming a substantially rectangular grid defining a plurality of can locating and supporting positions 22 on the sheet. A shaped rib 23 is formed at each position and the shaped ribs are ring shaped or circular in configuration, corresponding to the shape of the article to be engaged thereby. A plurality of relatively short article support ribs 24 are spaced around each shaped rib and extend into proximity with the spaced rib, defining an annular pocket for receiving the bottom end of the articles or cans C. These article support ribs extend in a direction along a radius of the shaped rib, or in other words, perpendicular to the shaped rib, and have sloping guide surfaces 25 on their ends adjacent the shaped rib for guiding a can into the pocket and wedging it against the shaped rib. A peripheral rib 26 extends around the periphery of the tray and at each juncture of the longitudinally and transversely extending ribs 20 and 21, a small diameter rib 27 is formed. As seen best in FIGS. 5, 6 and 7, the shaped ribs 23, article support ribs 24, peripheral rib 26 and small diameter ribs 27 are all of substantially the same height, defining an essentially uninterrupted surface over which the cans may slide as they are being moved into registry with the shaped ribs. The longitudinally and transversely extending ribs, as seen in FIG. 6, are of substantially less height for reasons of economy.

In order to reduce the amount of material required in the manufacture of the tray and to reduce its weight and cost, from both the standpoint of manufacturing and of handling and shipping, the tray is perforated with a plurality of holes or openings, including a large hole 28 completely occupying the area defined within each shaped rib 23, and a plurality of smaller holes 29 spaced around each juncture of a longitudinally extending rib and a transversely extending rib. The areas within the small diameter circularly shaped ribs at the junctures of the longitudinal and transverse ribs are also removed to form holes. Thus, only the minimal amount of material required for the tray is used, and the shape and configuration of the ribs impart adequate strength and rigidity to the tray for the intended purpose.

The resultant tray is very lightweight, resulting in substantial savings in shipping costs, and costs only about one-half as much to manufacture as the conventionally used cardboard cartons. Moreover, it is substantially impervious to damage by moisture and exposes to view substantially the entire can. By use of the tray, the cans are prevented from rubbing against one another and the damage resulting from such rubbing is therefore eliminated.

Because of its construction, the tray is readily used in packaging lines and high speed packaging equipment can operate at conventional speeds. The rib design is such that the cans freely slide over the surface of the tray during a loading operation and are only wedged into position when the cans reach their final position on the tray. Moreover, the trays themselves, having amooth bottom surfaces, slide relative to one another whereby they may be fed from a stack of trays to a loading station where the cans are moved onto the tray.

The tray may be made of injection molded plastic material which is recyclable, and in the finished package, as seen in FIG. 1, has great strength.

While the tray and package have been shown and described in detail, it is obvious that the invention is not to be limited to the exact form disclosed, and that changes in detail and construction may be made therein within the scope of the invention, without departing from the spirit thereof.

Having thus set forth and disclosed the nature of this invention, what is claimed is:

1. An article support tray for supporting a plurality of articles such as beverage cans in predetermined spaced position in a package containing a plurality of said articles, comprising:

a thin, flat sheet of lightweight plastic material having a smooth planar bottom surface, a top surface and side and end edges, said smooth bottom surface being free of pockets and protuberances and enabling one tray to slide freely over another tray;

a plurality of upstanding ribs formed on the top surface of the sheet, reinforcing the sheet and being coextensive in height, said ribs being spaced relative to one another and to the span of one of said articles so as to define an essentially coplanar and continuous support surface over which said articles are enabled to slide without interruption until the article reaches said predetermined position; and said ribs including a shaped rib at each said position adapted to peripherally engage in close-fitting conformity a peripherally complementally shaped end portion of one of said articles, and a plurality of guide ribs disposed in spaced relationship around each said shaped rib along axes extending radially to the shaped rib for engaging the periphery of an article at said position and wedging it securely in said position between the guide ribs and the shaped rib, preventing rubbing or chiming together of adjacent articles in a package of said articles, said plurality of guide ribs having sloping ends inclined toward the shaped rib and defining guide surfaces for guiding the articles into their final, at-rest position during their final movement into their predetermined position on the tray, and for wedging radially inwardly against the periphery of the article to wedge it in its final at-rest position.

2. An article support tray as claimed in claim 1, wherein:

the material of the sheet is removed in the area defined within each shaped rib, forming an opening through the sheet.

3. An article support tray as claimed in claim 1, wherein:

said ribs include a plurality of substantially linearly extending support ribs extending in the spaces between the shaped ribs, said support ribs and shaped ribs defining defining said surface over which said articles are freely slidable.

4. An article support tray as claimed in claim 3, wherein:

said guide ribs extend in a direction substantially perpendicular to the shaped rib at uniformly spaced locations relative to the shaped rib, and spaced from the shaped rib at their inner sloping guide surfaces, defining a pocket into which the article is received and supported in its predetermined position.

5. An article support tray as claimed in claim 4, wherein:

said tray is configured to hold and support a plurality of cylindrical beverage cans, said shaped ribs being circular or ring-shaped to conform to the shape of the end of one of said beverage cans, and said shaped rib being slightly smaller in diameter than the diameter of a can to be supported thereon, for engaging an inside bottom surface flange portion of a can; and said support and guide ribs are spaced peripherally around the shaped rib a distance such as to engage an outer bottom end surface portion of a can supported on the tray to wedge the can against the shaped rib.

6. An article support tray as in claim 3, wherein:

the linearly extending ribs include a plurality of elongate ribs extending longitudinally and transversely of the tray, defining a substantially rectangular grid forming a plurality of rectangular sections;

one of said shaped ribs being disposed in each section; and said support ribs extending from said elongate ribs toward the shaped rib in each section.

7. An article support tray as in claim 1, wherein:

the tray is made of injection molded plastic material.

* * * * *